United States Patent [19]

Gill

[11] Patent Number: 4,844,170

[45] Date of Patent: Jul. 4, 1989

[54] WELL PERFORATING GUN AND METHOD

[75] Inventor: Bennie C. Gill, Arlington, Tex.

[73] Assignee: Jet Research Center, Inc., Arlington, Tex.

[21] Appl. No.: 176,112

[22] Filed: Mar. 30, 1988

[51] Int. Cl.[4] ..... E21B 43/117

[52] U.S. Cl. ..... 166/297; 166/55; 175/4.51; 175/4.6; 102/320

[58] Field of Search ..... 166/297, 55; 175/4.51, 175/4.56, 4.57, 4.6; 102/320

[56] References Cited

U.S. PATENT DOCUMENTS

| | | | |
|---|---|---|---|
| 2,402,153 | 6/1946 | Elliott | 164/0.5 |
| 2,433,231 | 12/1947 | Martin | 164/0.5 |
| 2,565,788 | 8/1951 | Tow | 164/0.5 |
| 2,649,046 | 8/1953 | Davis | 102/20 |
| 2,680,406 | 6/1954 | Austin | 102/20 |
| 2,742,857 | 4/1956 | Turechek | 102/20 |
| 2,750,885 | 6/1956 | Schlumberger | 102/20 |
| 2,764,938 | 10/1956 | Harcus | 102/20 |
| 2,980,017 | 4/1961 | Castel | 102/20 |
| 3,346,056 | 10/1967 | Bohn | 175/4.6 |
| 3,773,119 | 11/1973 | Shore | 175/4.6 |
| 4,312,273 | 1/1982 | Camp | 102/310 |
| 4,467,878 | 8/1984 | Ibsen | 175/4.6 |
| 4,541,487 | 9/1985 | Revett | 166/297 |
| 4,583,602 | 4/1986 | Ayers | 175/4.52 |
| 4,635,734 | 1/1987 | Donovan et al. | 175/4.6 |
| 4,726,431 | 2/1988 | Oestreich et al. | 175/4.6 |

FOREIGN PATENT DOCUMENTS 1422004 11/1965 France .

*Primary Examiner*—Jerome W. Massie, IV
*Assistant Examiner*—Terry Lee Melius
*Attorney, Agent, or Firm*—Clark Dougherty, Jr.; Robert A. Kent

[57] ABSTRACT

A well perforating gun and method of perforating a subterranean surface within a well bore are provided. The perforating gun comprises a tubular gun body having a plurality of external recesses formed therein and positioned in spaced relationship on a helical path around the peripheral surface thereof. The recesses are all equally spaced one below another relative to the longitudinal axis of the gun body with each successive recess being laterally spaced from a preceding one by an angle of about 150°. Such spacing results in the first recess and every second one of the recesses thereafter lying on a second helical path and being laterally spaced by an angle of about 60°, and the first recess and every third one of the recesses thereafter lying on a third helical path and being laterally spaced by an angle of about 90°. Charge holder means are disposed in the gun body for selectively holding a number of explosive charges therewithin equal to and aligned with all of the recesses in the perforating gun body, or equal to and aligned with the first recess and every second recess thereafter, or equal to and aligned with the first recess and every third recess thereafter. A selected number of explosive charges are held by the charge holder means and explosive charge detonator means extending within the gun body are connected to the explosive charges.

10 Claims, 2 Drawing Sheets

WELL PERFORATING GUN AND METHOD

BACKGROUND OF THE INVENTION

1. Field of the Invention

This invention relates generally to a well perforating gun and method of perforating a subterranean surface within a well bore, and more particularly, to a perforating gun and method whereby three distinct helically distributed shot patterns can be selectively utilized with a single tool.

2. Description of the Prior Art

A variety of perforating guns and methods have been developed and used heretofore for forming openings known as perforations in a well which extend from the well bore into an adjacent formation. Generally, the perforating gun is loaded with explosive charges and lowered in the well bore on a tubing string or a wireline to a position adjacent the subterranean formation. The perforating gun is usually of an elongated tubular configuration, and the charges are shaped charges having conically constrained explosive material therein which are distributed over the length of the gun. The detonation of the charges can be activated electronically or mechanically depending upon the technique used for lowering the perforating gun in the well bore. When the charges are detonated, elongated explosive jets are formed which produce perforations through any casing, liner, cement, or the like in the well bore and into the subterranean formation adjacent the well bore.

Perforating guns have heretofore been comprised of a closed fluid-tight tubular gun body adapted to be lowered in a well bore having a charge holder disposed therein with explosive charges attached thereto in a selected spatial distribution. Detonating means connected to the explosive charges are activated from the surface when the perforating gun has been positioned adjacent a subterranean formation to be perforated. The explosive jets produced upon detonation of the explosive charges must first penetrate the perforating gun body before penetrating materials in the well bore and the adjacent formation. In order to reduce the resistance produced by the perforating gun body and increase the depth of perforation penetration in the formation, the perforating gun body has heretofore been provided with external recesses which leave relatively thin wall portions through which the explosive jets pass. The recesses in the gun body must be positioned in a spatial distribution thereon which corresponds to the spatial distribution of the explosive charges held within the gun body by the charge holder.

As will be understood, the spatial distribution of the explosive charges held within the perforating gun body by the charge holder and the corresponding spatial distribution of the recesses in the perforating gun body dictate the spatial distribution of the perforations formed by the perforating gun (referred to as the "shot pattern"). Different shot patterns are required to achieve desired results in different well applications. For example, in perforating very thin formations known as "laminated formations", the longitudinal spacing between perforations must be very close. In the perforation of very thick formations, the opposite is true. In deviated well bores and well bores traversing unconsolidated formations, it is often desirable to have increased longitudinal spacing between perforations to prevent the formation from collapsing into the formed perforations and/or into the well bore.

The spatial distribution of the explosive charges also affects the shock load applied to the perforating gun structure upon the detonation of the charges. Generally, it has been found in the art that the least shock load is applied to a perforating gun having single charges in horizontal planes which are spaced one below the other longitudinally and which are successively detonated. In order to produce a 360° shot pattern, the charges are circumferentially offset, i.e., the discharge end of each successive charge is laterally spaced from a preceding charge whereby the discharge ends of the charges as well as the corresponding recesses in the perforating gun body lie on a helical path. The successive detonation of the charges along the helical path produces a shot pattern and perforations around and over the length of the perforated interval.

In order to provide perforating guns capable of producing different helical shot patterns in different well applications, it has heretofore been necessary to have available a number of different recessed perforating gun bodies and charge holders. Thus, although there are perforating guns which perform satisfactorily in particular uses, there is a need for an improved single perforating gun design whereby such gun can be utilized in a plurality of different well perforation applications.

SUMMARY OF THE INVENTION

The present invention meets the need for an improved perforating gun design which can be utilized in a plurality of applications as opposed to the use of a different perforating gun for each different application. That is, the perforating gun and method of the present invention selectively produce three distinct shot patterns, i.e., shot distributions following different helical paths. The spacing of the shots in the three patterns relative to the longitudinal axis of the perforating gun is different, and the lateral spacing or circumferential offset (referred to in the art as "phasing") of the shots in the three patterns is 150°, 90° or 60°. In order to change the perforating gun from one shot pattern to another, it is only necessary to change the number and location of explosive charges connected to the charge holder disposed within the perforating gun body.

The well perforating gun of the present invention is comprised of a tubular perforating gun body having a plurality of recesses formed therein positioned on a first helical path around the outer peripheral surface thereof. The recesses are all equally spaced one below another relative to the longitudinal axis of the gun body, with each successive recess being laterally spaced from a preceding recess by an angle of about 150° whereby the first and every second one of the recesses thereafter lie on a second helical path and are laterally spaced by an angle of about 60°, and the first and every third one of the recesses thereafter lie on a third helical path and are laterally spaced by an angle of about 90°. Charge holder means are disposed in the gun body for holding explosive charges therewithin which are selectively equal in number and in alignment with all of the recesses, or equal in number and in alignment with the first and every second recess thereafter, or equal in number and in alignment with the first and every third recess thereafter. A selected number of explosive charges are held by the charge holder means, and explosive charge detonator means extending within the gun body are connected to the explosive charges.

By the method of the present invention, a perforating gun body having the above-described spatial distribution of recesses formed therein and a charge holder for selectively holding explosive charges as described above within the perforating gun body are provided. Explosive charges are connected to the charge holder in a number equal to and for alignment with all of the recesses in the perforating gun body resulting in a shot pattern having 150° phasing, or in a number equal to and for alignment with the first and every second recess thereafter resulting in a shot pattern having 60° phasing, or in a number equal to and for alignment with the first and every third recess thereafter resulting in a shot pattern having 90° phasing. Detonating means are connected to the charges, and the charge holder having the explosive charges connected thereto with detonating means connected to the charges is placed in the perforating gun body whereby the discharge ends of the explosive charges align with the recesses in the gun body. The perforating gun body containing the explosive charges and detonating means is then lowered in a well bore to a position adjacent a surface therein, and the detonating means are caused to detonate the explosive charges.

It is, therefore, a general object of the present invention to provide an improved well perforating gun and method.

A further object of the present invention is the provision of an improved well perforating gun and method wherein one of three different helical shot patterns can be produced using a single perforating gun simply by changing the number and position of the explosive charges utilized in the gun.

Other and further objects, features and advantages of the present invention will be readily apparent to those skilled in the art upon a reading of the description of preferred embodiments which follows when taken in conjunction with the accompanying drawings.

DETAILED DESCRIPTION OF THE PREFERRED EMBODIMENT

Figure 1:
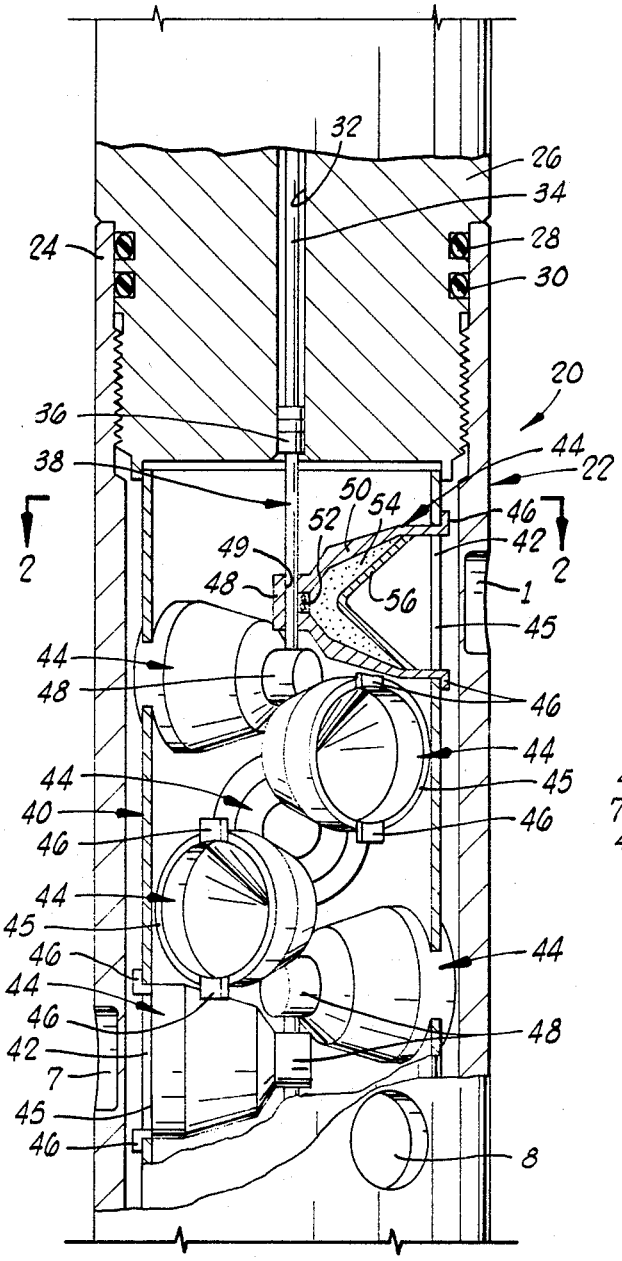
FIG. 1 is a side cross-sectional view of a portion of a perforating of the present invention.
Figure 2:
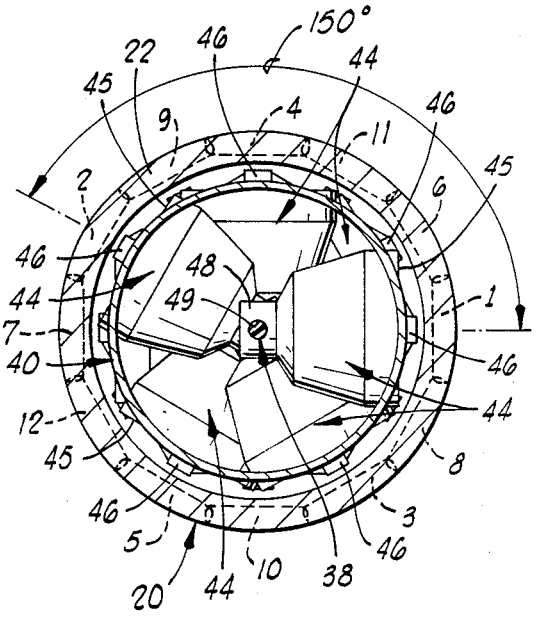
FIG. 2 a cross-sectional view taken along line 2—2 of FIG. 1.

Referring now to the drawings, and particularly to FIGS. 1 and 2, the improved perforating gun apparatus of the present invention is illustrated and generally designated by the numeral 20. Only a part of the gun 20 is shown in FIGS. 1 and 2 because the remainder of the design follows from what is shown and will be understood by those skilled in the art.

The perforating gun 20 includes an outer tubular perforating gun body 22 having a plurality of external recesses formed therein. While, as will be understood, the gun body 22 includes recesses over its entire length, recesses designated by the numerals 1 through 8 are included in that part of the gun body 22 illustrated in FIGS. 1 and 2. The recesses 1 through 8 as well as the other recesses which are not shown in the gun body 22 are positioned on a first helical path around the outer peripheral surface of the gun body 22. Further, the recesses are all equally spaced one below the other relative to the longitudinal axis of the gun body 22, and as shown best in FIG. 2, each successive recess is laterally spaced from a preceding recess by a phasing angle of 150°. That is, referring specifically to FIG. 2, the lateral spacing between recess 1 and recess 2 in the gun body 22 is 150°. In a like manner, recess 3 is laterally spaced from recess 2 by an angle of 150°, recess 4 is laterally spaced from recess 3 by 150°, and so on. While the spacing between longitudinally adjacent recesses in the gun body 22 can be varied, a preferred spacing is one inch whereby a shot pattern having twelve shots per foot and 150° phasing is produced by the perforating gun 20 when the maximum number of charges is utilized therein as illustrated in FIG. 1. It should be noted that the helical path on which the recesses in the gun body 22 lie can have a rotation in either direction.

The top end portion 24 of the gun body 22 includes internal threads, and the gun body 22 is threadedly connected to a coupling adapter 26. The coupling adapter 26 is adapted to be connected to a tubing string or a wireline whereby the entire perforating gun 20 can be lowered into a well bore. A pair of 0-ring sealing members 28 and 30 are disposed in annular grooves formed in the coupling adapter 26 whereby a fluid-tight seal is provided between the coupling adapter 26 and the gun body 22. In one typical arrangement, the coupling adapter 26 includes a longitudinal passage 32 positioned coaxially therein for containing an electric ignitor cable 34 connected to an igniter 36. The igniter 36 is in turn attached to a detonator cord 38 which extends into the interior of the gun body 22. The lower end of the gun body 22 (not shown) is also closed in a fluid-tight manner such as by the use of a threaded plug and additional 0-rings. As is well understood by those skilled in the art, the igniter 36 can be located differently depending upon whether the adapter 26 is tubing or wireline connected, and more than one perforating gun 20 can be connected in series with or without spacers in between.

Disposed within the gun body 22 is an elongated tubular, preferably cylindrical, charge holder 40. The charge holder 40 includes a plurality of openings 42 disposed therein positioned on a helical path and in alignment with the external recesses in the gun body 22. Connected within each of the openings 42 of the charge holder 40 is a shaped explosive charge 44. That is, the outer or discharge end 45 of each shaped charge 44 is connected within an opening 42 of the charge holder 40 such as by a pair of tabs 46 connected to the charge 44. The tabs 46 extend through the openings 42 and engage outer surfaces of the charge holder 40. The interior ends 48 of the charges 44 are positioned on a line substantially coincident with the axis of the cylindrical charge holder 40 and include openings 49 through which the detonating cord 38 is successively passed.

Each of the shaped charges 44 is identically constructed in a manner known to the art. Generally, as shown in FIG. 1, each charge 44 includes a support cup 50 to which the detonating cord 38 is connected at the interior end 48 thereof and the tabs 46 are attached at the outer end. An aperture 52 is provided at the apex of the cavity defined by the cup 50 which communicates with the opening 49 containing the detonator cord 38, and explosive material 54 is confined within the cup 50 by a conical liner 56. The liner 56 constrains the explosive material in a hollow, substantially conical configuration. When the explosive material 54 is detonated, an explosive jet is formed which travels from the discharge end 45 of the charge 44 to the exterior of the perforating gun 20 by way of a recess in the perforating gun body 22 positioned in alignment with the charge 44. As shown best in FIG. 2, when the perforating gun 20 utilizes the maximum number of charges 44, a charge 44 is held by the charge holder 40 in each of the openings 42 thereof in alignment with one of the recesses 1 through 8 as well as the other recesses which are not shown in the gun body 22. This results in a shot pattern being produced by the perforating gun 22 having a phasing of 150°. However, as will be described hereinbelow, when a shot pattern is desired having a phasing of 60° and a greater longitudinal spacing between shots or a phasing of 90° and an even greater spacing, certain of the charges 44 are omitted whereby the charges are equal in number to and positioned in alignment with the first recess and every second recess thereafter, or the charges are equal in number to and positioned in alignment with the first recess and every third recess thereafter. A charge 44 is positioned in alignment with a particular recess in the gun body 22 when the charge 44 is held by the charge holder 40 with the discharge end 45 thereof adjacent the interior surface of the portion of the gun body 22 which forms the bottom of that recess.

Figure 3A:
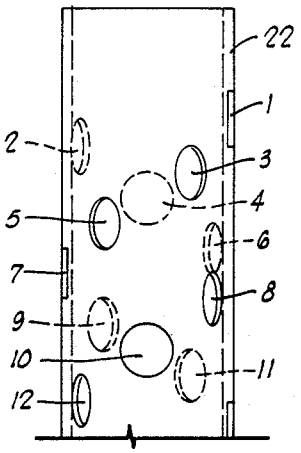
FIGS. 3A, 3B and 3C illustrate the arrangement of recesses on the perforating gun body and the first selectable helical shot pattern of the present invention.

Referring now to FIGS. 3A through 5C, the three alternate shot patterns which can be selectively utilized in accordance with the present invention are illustrated. Referring particularly to FIGS. 3A, 3B and 3C, the positioning of the first twelve recesses in the gun body 22, designated by the numerals 1 through 12, is illustrated. The recesses 1 through 12 form a helical path around the outer peripheral surface of the gun body 22 as shown in FIG. 3A. The circumferential positioning of each of the recesses 1 through 12 is shown in FIG. 3B which is a schematic top end view of the gun body 22, and the helical distribution of the recesses 1 through 12 is further illustrated in FIG. 3C which schematically represents an inside section of the gun body 22 unfolded from the location of the top recess 1. Thus, as illustrated in FIGS. 3A, 3B and 3C, the recesses 1 through 12 and other recesses in the perforating gun body 22 which are not shown are positioned on a helical path around the outer peripheral surface of the gun body 22, the recesses are equally spaced one below another relative to the longitudinal axis of the gun body and each successive recess is laterally spaced from a preceding recess by an angle of about 150°. As stated above, when a one-inch spacing between longitudinally adjacent recesses, e.g., recesses 1 and 2, is utilized, the resulting shot pattern has a spacing of twelves shots per foot and a phasing of 150°.

Figure 4A:
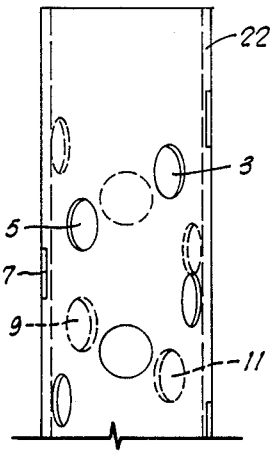
FIGS 4A, 4B and 4C illustrate the second selectable shot pattern of the present invention.
Figure 4B:
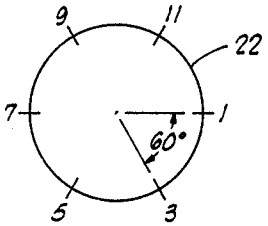
Figure 4C:
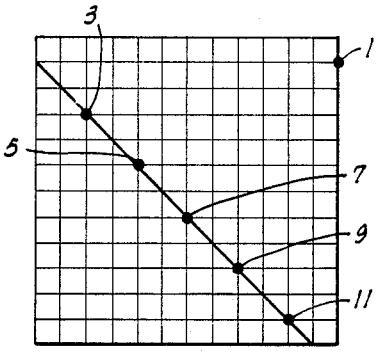

Referring now to FIGS. 4A through 4C, a second helical path is illustrated on which the first and every second one of the recesses in the perforating gun body 22 lie, i.e., recesses numbers 1, 3, 5, 7, 9, 11 and so on as indicated in FIG. 4A. As shown in FIG. 4B, those recesses have a phasing of 60°. As illustrated by comparison of FIG. 4C with FIG. 3C, the second helical path on which recesses 1, 3, 5, 7, 9 and 11 lie has an opposite rotation from the helical path on which all of the recesses in the gun body 22 lie, and the spacing of the first and every second recess thereafter relative to the longitudinal axis of the gun body 22 is doubled. In the preferred embodiment where the spacing between longitudinally adjacent recesses in the gun body 22 is one inch, the longitudinal spacing between the first and every second recess thereafter is two inches whereby the resulting shot pattern has 6 shots per foot and a 60° phasing.

Figure 5A:
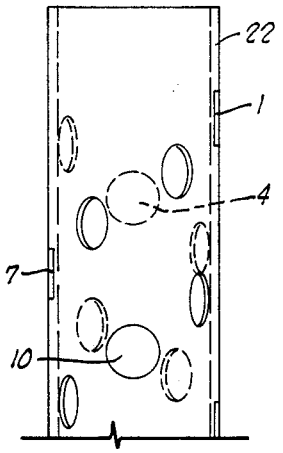
FIGS. 5A, 5B and 5C illustrate the third selectable shot pattern of the present invention.
Figure 3B:
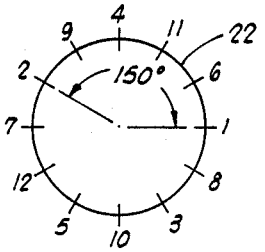
Figure 5B:
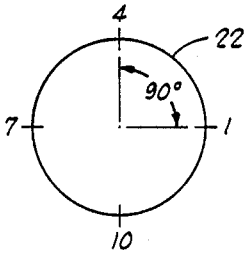
Figure 3C:
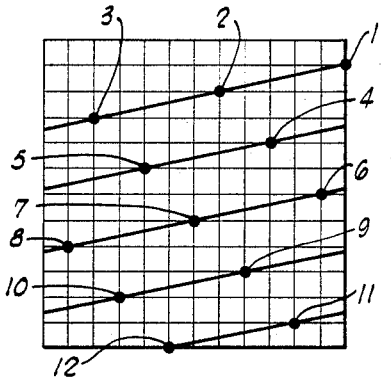
Figure 5C:
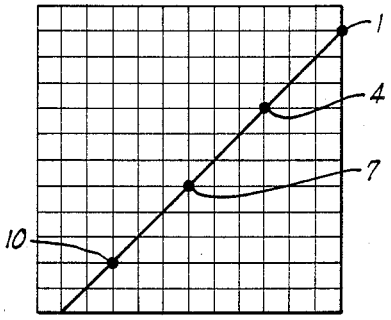

Referring now to FIGS. 5A, 5B and 5C, the third optional recess distribution resulting in the third shot pattern is illustrated which is formed by the first recess and every third recess thereafter, i.e., recesses 1, 4, 7, 10, etc. Such distribution results in a 90° phasing as illustrated in FIG. 5B and a helical path as shown in FIG. 5C having three times the longitudinal spacing between adjacent recesses as compared to when all of the recesses in the gun body 22 are utilized. In the preferred embodiment of the gun body 22 having one-inch spacing between longitudinally adjacent recesses, the third distribution formed by recesses 1, 4, 7, 10, etc., produces a shot pattern having four shots per foot and a 90° phasing.

In carrying out the method of the present invention, a perforating gun body 22 is provided having the helical recess distribution described above, i.e., a recess distribution of desired equal spacing between longitudinally adjacent recesses (preferably one inch), and with each successive recess being laterally spaced from a preceding recess by an angle of about 150°. A charge holder 40 of the type described above for holding the discharge ends of explosive charges in a helical distribution complementary to the recess distribution of the gun body 22 is also provided.

Explosive charges 44 are connected to the charge holder 40 in a number equal to and for alignment with either all of the recesses in the gun body, or the first recess and every second one thereafter, or the first recess and every third one thereafter depending upon the particular shot pattern desired. That is, a shot pattern having 150° phasing and a particular spacing (preferably twelve shots per foot), or a shot pattern having 60° phasing and double the spacing (preferably six shots per foot), or a shot pattern having 90° phasing and three times the spacing (preferably four shots per foot) can be optionally selected. Once the selected number of the charges 44 are connected to the charge holder 40, the detonating cord 38 is successively connected to the charges 44 at the interior ends 48 thereof. The charge holder 40 having the explosive charges 44 connected thereto and the detonating cord 38 connected to the charges is then placed in the gun body 22 whereby the charges are in alignment with corresponding recesses in the gun body 22. The coupling adapter 26 is next connected to the gun body 22, and the perforating gun 20 is lowered in a well bore to a position adjacent a surface therein. Once positioned, the perforating gun is operated to form perforations in the desired shot pattern by activating the ignitor 36 which in turn ignites the detonating cord 38 and detonates the explosive charges 44.

Thus, by the present invention, a perforating gun and method are provided whereby one of three optional shot patterns can be selected by simply connecting a particular number and arrangement of explosive charges to the charge holder, placing the charge holder and charges in the gun body and assemblying the gun for use. This can be accomplished at the job site using the universal charge holder 40, or individual charge holders adapted for holding only charges in alignment with the first and every second recess thereafter or the first and every third recess thereafter can be utilized. Because the three optional shot patterns provided are different in both shot phasing and shot spacing, the perforating gun and method of this invention can be used in a wide variety of well perforating applications.

The present invention, therefore, is well adapted to carry out the objects and attain the ends and advantages mentioned as well as those inherent therein. While numerous changes can be made in the arrangement and construction of parts as well as in the number and order of steps, such changes are encompassed within the spirit of this invention as defined by the appended claims.

What is claimed is:

1. A well perforating gun comprising:

a tubular perforating gun body having a plurality of recesses formed therein positioned on a first helical path around the outer peripheral surface thereof, said recesses all being equally spaced one below another relative to the longitudinal axis of said gun body with each successive recess being laterally spaced from a preceding recess by an angle of about 150° whereby the first and every second one of said recesses thereafter lie on a second helical path and are laterally spaced by an angle of about 60°, and the first and every third one of said recesses thereafter lie on a third helical path and are laterally spaced by an angle of about 90°;

charge holder means comprising a single elongated hollow cylindrical charge holder disposed in said gun body for holding explosive charges therewithin which are selectively equal in number and in alignment with all of said recesses, or equal in number and in alignment with the first and every second recess thereafter, or equal in number and in alignment with the first and every third recess thereafter;

a selected number of explosive charges held by said charge holder means, the interior ends of said charges being positioned on a line substantially coincident with the axis of said charge holder and having openings into which detonator means may be successively passed; and explosive charge detonator means extending within said gun body connected to said explosive charges through said openings in said charges.

2. The perforating gun of claim 1 wherein said recesses in said perforating gun body are substantially cylindrical in shape.

3. A perforating gun comprising:

an elongated cylindrical perforating gun body adapted to be lowered in a well bore, said body having a plurality of recesses formed therein and positioned on a first helical path around the outer peripheral surface thereof, said recesses all being equally spaced one below another relative to the longitudinal axis of said gun body with each successive recess being laterally spaced from a preceding recess by an angle of about 150° whereby the first and every second one of said recesses thereafter lie on a second helical path and are laterally spaced by an angle of about 60°, and the first and every third one of said recesses thereafter lie on a third helical path and are laterally spaced by an angle of about 90°;

a single elongated hollow cylindrical charge holder disposed in said perforating gun body, said charge holder including a plurality of openings therein for holding the discharge ends of a selected number of explosive charges adjacent the interior surfaces of said perforating gun body with the interior ends of said charges positioned on a line substantially coincident with the axis of said body, said openings being equal in number and in alignment with said recesses in said perforating gun body;

explosive charges held by said charge holder in a selected number equal to and positioned in alignment with all of said recesses, the first recess and every second one thereafter, or the first recess and every third one thereafter, the interior ends of said charges being positioned on a line substantially coincident with the axis of said charge holder and having openings into which detonating means may be successively placed and detonator means extending within said perforating gun body and said cylindrical charge holder connected to said explosive charges by placing the detonating means in the openings at the interior ends of said charges.

4. The perforating gun of claim 3 wherein said recesses in said perforating gun body are substantially cylindrical in shape.

5. A method of perforating a subterranean surface within a well bore comprising the steps of:

providing a perforating gun body adapted to be lowered in said well bore to said surface, said perforating gun body having a plurality of external recesses formed therein and positioned in spaced relationship on a first helical path around the outer peripheral surface thereof, said recesses all being equally spaced one below another relative to the longitudinal axis of said gun body with each successive recess being laterally spaced from a preceding recess by an angle of about 150° whereby the first and every second one of said recesses thereafter lie on a second helical path and are laterally spaced by an angle of about 60° and the first and every third one of said recesses thereafter lie on a third helical path and are laterally spaced by an angle of about 90°;

providing a charge holder comprising a single elongated hollow tubular body for selectively holding explosive charges connected thereto within said perforating gun body in a number equal to and in alignment with said recesses in said perforating gun body;

connecting explosive charges to said charge holder in a number equal to and for alignment with all of said recesses in said perforating gun body thereby providing a shot pattern of 150 degree phase, or in a number equal to and for alignment with the first recess and every second one thereafter, thereby providing a shot pattern of 60 degree phase, or in a number equal to and for alignment with the first recess and every third one thereafter thereby providing a shot pattern of 90 degree phase, the interior ends of said charges being positioned on a line substantially coincident with the axis of said charge holder and having openings into which detonating means may be successively placed;

connecting detonating means to said charges by placing the detonating means in the openings at the interior ends of said charges;

placing said charge holder having said explosive charges connected thereto and detonating means connected to said explosive charges in said perforating gun body whereby said explosive charges align with recesses in said body;

lowering said perforating gun body containing said explosive charges and detonating means in said well bore to a position adjacent said surface therein; and causing said detonating means to detonate said explosive charges.

6. The method of claim 5 wherein said recesses in said perforating gun body are substantially cylindrical in shape.

7. The method of claim 6 wherein said recesses in said perforating gun body are spacer relative to the longitudinal axis of said gun body whereby said gun body includes twelve recesses per foot measured along said longitudinal axis.

8. The method of claim 5 wherein said recesses in said perforating gun body are spaced relative to the longitudinal axis of said gun body whereby said gun body includes twelve recesses per foot measured along said longitudinal axis, and explosive charges are connected to said charge holder in a number equal to and in alignment with all of said recesses in said perforating gun body.

9. The method of claim 5 wherein said recesses in said perforating gun body are spaced relative to the longitudinal axis of said gun body whereby said gun body includes twelve recesses per foot measured along said longitudinal axis, and explosive charges are connected to said charge holder in a number equal to and in alignment with the first recess and every second one of said recesses thereafter.

10. The method of claim 5 wherein said recesses in said perforating gunbody are spaced relative to the longitudinal axis of said gun body whereby said gun body includes axis, and explosive charges are connected to said charge holder in a number equal to and in alighnment with the first recess and every third one of said recesses thereafter.

* * * * *